United States Patent [19]

Scribner

[11] 4,242,566

[45] Dec. 30, 1980

[54] HEAT-PRESSURE FUSING DEVICE

[75] Inventor: Albert W. Scribner, Darien, Conn.

[73] Assignee: Pitney Bowes Inc., Stamford, Conn.

[21] Appl. No.: 132,458

[22] Filed: Mar. 21, 1980

[51] Int. Cl.[3] ..... H05B 1/00; G03G 15/20

[52] U.S. Cl. ..... 219/216; 118/641; 118/60; 219/244; 219/388; 219/469; 219/530; 432/60

[58] Field of Search ..... 219/216, 243, 244, 358, 219/388, 469, 470, 471; 427/194; 118/60, 641; 432/8, 60, 127, 228; 156/582, 583; 100/93 RP; 29/121 R; 250/317

[56] References Cited

U.S. PATENT DOCUMENTS

| | | | |
|---|---|---|---|
| 2,556,008 | 6/1951 | Spalding | 219/469 X |
| 2,958,367 | 11/1960 | Gournelle | 219/469 X |
| 3,374,769 | 3/1968 | Carlson | 118/641 |
| 3,449,547 | 6/1969 | Goodman et al. | 219/216 |
| 3,637,976 | 1/1972 | Ohta et al. | 219/216 |
| 3,666,247 | 5/1972 | Banks | 219/388 X |
| 3,906,562 | 9/1975 | Angliss et al. | 219/388 X |
| 3,937,919 | 2/1976 | Clerx et al. | 219/216 |
| 3,953,709 | 4/1976 | Elter | 219/216 |
| 4,125,760 | 11/1978 | Nyfiler | 219/388 |
| 4,180,721 | 12/1979 | Watanabe et al. | 219/216 |

*Primary Examiner*—Volodymyr Y. Mayewsky
*Attorney, Agent, or Firm*—Melvin J. Scolnick; William D. Soltow, Jr.; Albert W. Scribner

[57] ABSTRACT

A heat-pressure fusing apparatus that exhibits high thermal efficiency is disclosed. The fusing apparatus comprises at least one pair of first and second oppositely driven pressure fixing feed rollers, each of the rollers having an outer layer of a thermal insulating material; first and second idler rollers, a first flexible endless belt disposed about the first idler roller and each of the first pressure feed rollers and a second flexible endless belt disposed about the second idler roller and each of the second pressure feed rollers, at least one of the belts having an outer surface formed of a thermal conductive material, wherein there is defined an area of contact between the outer surfaces of the first and second belts located between the first and second pressure feed rollers for passing the copy sheet between the two belts under pressure; and means spaced relative to the belt whose outer surface comprises the thermal conductive material for heating the outer surface thereof, whereby when an unfused copy sheet is passed through the area of contact between the two belts it is subject to sufficient heat and pressure to fuse developed toner images thereon.

18 Claims, 5 Drawing Figures

HEAT-PRESSURE FUSING DEVICE

BACKGROUND OF THE DISCLOSURE

I. Field of the Invention

This invention relates to a heated pressure fusing apparatus as is commonly used in xerographic copying machines, and more particularly to a heated fusing apparatus for fusing toner images on a support surface such as a sheet of paper which apparatus is capable of operating with thermal efficiency.

II. Description of the Prior Art

In a typical xerographic process a photoconductor comprising a photoconductive composition coated on a rigid or flexible substrate is uniformly electrostatically charged in the dark and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is removed and the photoconductor is reused as described above for subsequent copies. The toner image that was transferred to the plain paper is then fixed thereto. Since the developing material is heat fusible, application of sufficient heat to the paper causes the developing material to melt and be fused into the paper so as to be permanently affixed thereto.

One very basic approach to fusing in a xerographic copying machine is the use of the so-called heated pressure fusing apparatus. Typically, in this apparatus, the paper with the toner image thereon is passed between a pair of opposed and cooperating rollers, at least one of which is heated. Generally, the heated roll is formed of a hollow cylinder having a radiant heater, such as an infrared lamp or a halogen lamp, centrally located within the cylinder to heat the roll, in series with a bimetal thermostat. A typical example of this type of heated fuser roll is illustrated in U.S. Pat. No. 3,637,976. During operation of the fusing apparatus, the paper to which the toner images are electrostatically adhered is passed through the nip formed between the rolls with the toner image contacting the fuser roll to effect heating of the toner image within the nip. Fusing is enhanced by the second roll or pressure roll as it is commonly called as the result of a biasing force which forces the rolls into engagement. The thermostat intermittently interrups the current flow as the roll temperature reaches a predetermined value. The roll then cools to some lower temperature whereupon the thermostat restores the current, and the roll heats up again.

There are, however, many problems that occur with the type of internally heated pressure fusing apparatus as described above. For example, in many of the known hot-roll fusers it is extremely difficult to maintain a constant temperature at the nip of the rollers where the actual fusing of the toner occurs, and where temperature control is critical. Temperature control is difficult because (1) it is difficult to sense the temperature in this region: (2) thermal lag, i.e., the responsiveness of roll temperature under varying demands of thermal output; and (3) there are both different machine modes, i.e., standby, off, continuous operation, and different size papers to contend with. In addition, internally heated fuser rolls generally require the use of very high heating temperatures for the internal heating elements to enable the outer surface roll temperature in the nip of the rollers to be high enough to melt the toner. The use of these high temperatures can result in deterioration of the fuser roll. Furthermore, and in general, the thermal efficiency of known heated-pressure fusing devices is fairly low.

Examples of other miscellaneous type heated rolls exhibiting many of the problems as outlined above are illustrated in U.S. Pat. Nos. 3,471,683, 3,720,808 and 4,100,397.

SUMMARY OF THE INVENTION

It is therefore an object of the present invention to overcome many of the disadvantages of the heated pressure roll type fusers known in the art, and to provide a heated pressure roll type fusing apparatus which avoids the problems associated with internally heated fuser rolls.

It is a further object of this invention to provide a heated pressure-roll fusing apparatus that is thermally efficient.

The foregoing objects and others are accomplished in accordance with the present invention by providing a fusing apparatus for applying heat and pressure to a copy sheet to fix developed toner images thereto comprising at least one pair of first and second oppositely driven pressure fixing feed rollers, each of the rollers having an outer layer of a thermal insulating material thereon; first and second idler rollers, a first flexible endless belt disposed about the first idler and each of the first pressure feed rollers, and a second flexible endless belt disposed about the second idler roller and each of the second pressure feed rollers, at least one of the belts having an outer surface formed of a thermal conductive material wherein there is defined an area of contact between the outer surfaces of the first and second belts located between the first and second pressure feed rollers for passing the copy sheet between the two belts under pressure; and means spaced relative to the belt whose outer surface comprises the thermal conductive material for heating the outer surfaces thereof whereby when an unfused copy sheet is passed through the area of contact between the two belts it is subject to sufficient heat and pressure to fuse developed toner images thereon.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
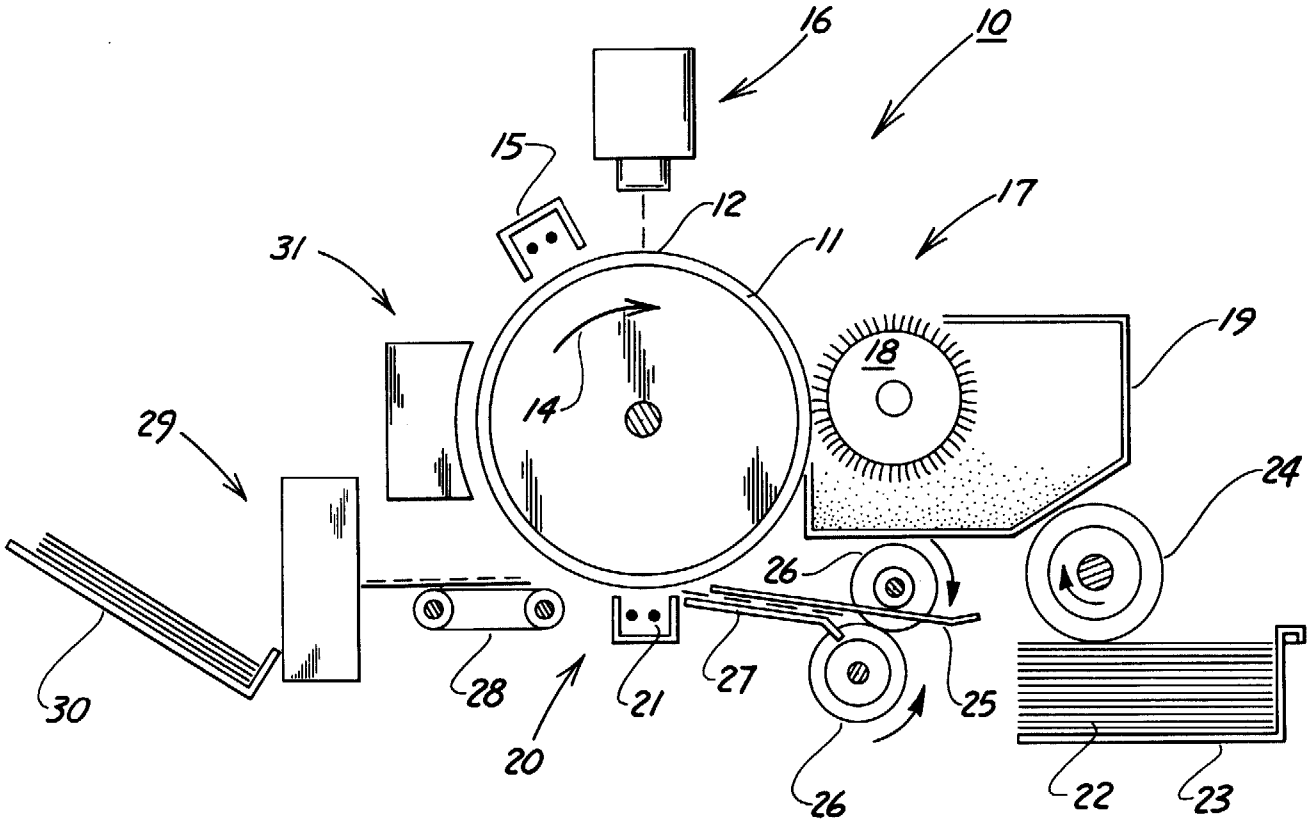
FIG. 1 is a schematic sectional view of a copier.

Referring now to the drawings, and particularly to FIG. 1 thereof, there is shown an electrophotographic copying machine employing a fusing device in which a heated pressure fusing apparatus roll in accordance with the present invention can be utilized. The various processing stations shown in FIG. 1 will be represented in part as blocks and the processing stations will only be briefly described. The particular copying machine illustrated in FIG. 1 is merely exemplary as far as the present invention is concerned for a complete understanding of a xerographic process and, in particular, how a fusing apparatus is employed in such a process. A fusing apparatus in accordance with the present invention may be utilized in a wide variety of devices including coated paper copiers and plain paper copiers, and is not necessarily limited to the particular type of copier system shown in FIG. 1.

In FIG. 1, reference numeral 10 generally designates an electrophotographic copying machine which includes a rotating drum 11 having a photoconductive surface 12 secured around the outer surface of the drum. Any of the numerous inorganic or organic photoconductive materials can be employed, such as for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed faced down for copying. Overlying the platen would be a movable cover connected to one side of the carriage. An operator can raise and lower the cover and thereby place on or remove documents from the platen. A series of lamps would be used to illuminate the original document. By incorporating an optical system comprising a series of mirrors and lenses a light image of the original document to be copied is projected onto the charged portion of photoconductive surface 12. The movement of the carriage and therefore the scanning of the original document is in timed relationship with the movement of rotating drum 11. Thus, photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles usually a heat settable plastic. However, a single component toner can also be used. Preferably a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removably tray 23. A feed roller 24 feeds the uppermost copy sheet from the supply 22, through paper guide 25 and into the nip of queuing rollers 26. At a predetermined time in the course of a copy cycle, the queeuing rollers 26 are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable apparatus, and advanced by belt conveyor 28 to fixing station 29.

Figure 5:
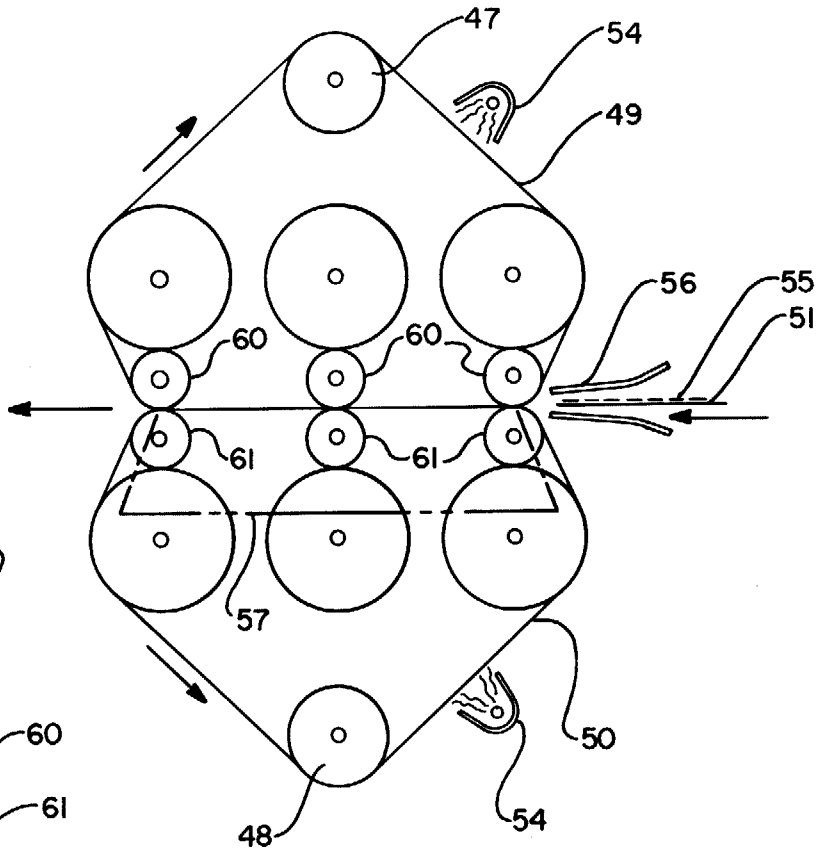
FIG. 5 is a schematic sectional view of a further embodiment of a heated pressure fusing apparatus in accordance with the present invention employing the pressure roll assembly illustrated in FIG. 4.
Figure 2:
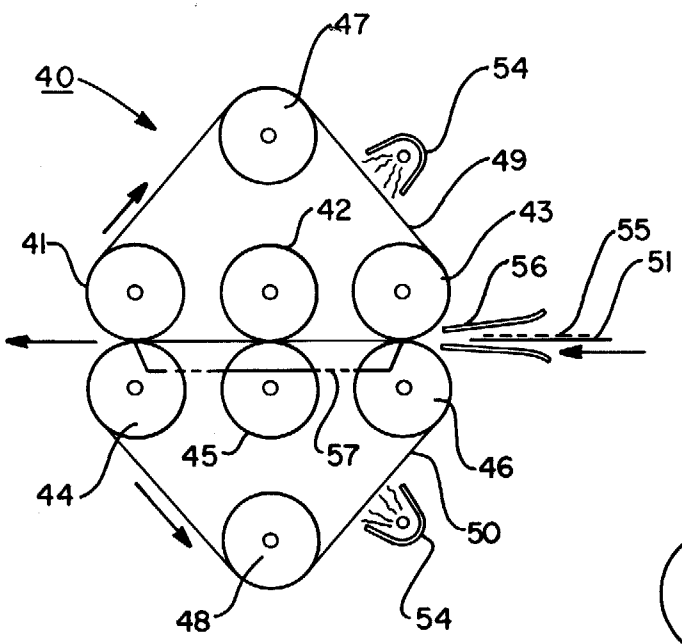
FIG. 2 is a schematic sectional view of an embodiment of a heated pressure fusing apparatus in accordance with the present invention.

The copy sheet then passes into fixing station 29 which includes a fusing apparatus in which the toner material now residing on the copy paper is heated to a temperature at which the toner particles melt and are thereby fused into the copy paper so as to form a permanent copy of the original document. In accordance with the present invention a fusing apparatus as shown in FIG. 2 or FIG. 5, and as more fully described hereinbelow can be used. After the toner image is permanently affixed to the copy sheet, the sheet is advanced to a catch tray 30 for subsequent removal from the copier by an operator.

In order to remove residual toner particles which adhere to photoconductive surface 12 after the transfer of the powder image to the copy sheet, copying machine 10 is provided with a cleaning system generally designated as 31. The cleaning system can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Referring now to the specific subject matter of the present invention, there is illustrated in FIG. 2 a preferred embodiment of a fusing apparatus in accordance with the features of the present invention. Specifically, there is shown fusing apparatus 40 including in combination a plurality of pairs of rollers, i.e. 41 and 44, 42 and 45, 43 and 46; including upper rollers 41, 42 and 43 and lower rollers 44, 45 and 46; first and second idler rollers 47 and 48; a first flexible endless belt 49 disposed about first idler roller 47 and upper pressure rollers 41, 42 and 43; and a second flexible endless belt 50 disposed about second idler roller 48 and lower pressure rollers 44, 45 and 46. Belts 49 and 50 move in the direction as indicated by the arrows shown, and are driven by the various rollers as described above and a drive system (not shown) such that a copy sheet 51 having a developed toner image thereon can be driven through fusing apparatus 40 between flexible belts 49 and 50 under pressure. Although the embodiments of the present invention shown in the drawings illustrates a fusing apparatus having three pairs of rollers, it is to be understood that the specific embodiments shown are only examples of the types of fusing apparatus that are covered by the present invention, and that it is clearly within the scope of the present invention for the fusing apparatus to have one, two, three, four or even more pairs of first and second oppositely driven pressure fixing feed rollers such as the pair of pressure fixing feed rollers 41 and 44.

Figure 3:
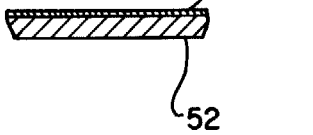
FIG. 3 is a schematic sectional view of the flexible belt shown in FIG. 2.

In accordance with the present invention, and to reduce heat losses in the fusing system, and have a heated pressure fusing apparatus that exhibits high thermal efficiency, (1) each of pressure rolls 41, 42, 43, 44, 45 and 46 are preferably constructed of rolls whose outer surfaces are formed of a layer of a thermal insulating material, and (2) at least one of flexible belts 49 or 50 is constructed of a layered configuration as shown in FIG. 3 wherein the belt comprises a backing layer 52 of a thermal insulating material having a thin (e.g. ranging from about 0.003 "to 0.005") layer 53 of a thermal conductive material such as, for example a metal, thereon. Although it is within the scope of the present invention to use only one flexible belt having an outer surface formed of a thermal conductive material (the other belt having its outer surface formed of a thermal insulating material) it is preferred, as shown in FIG. 2, that both belts 49 and 50 be constructed of the layered configuration as shown in FIG. 3 and have their outer surfaces formed of a thermal conductive material. Pressure fixing feed rollers 41, 42, 43, 44, 45 and 46 can, for example, be approximately one inch in outside diameter and be formed of a metal core having a 1/16 inch layer of a thermal insulating material thereon.

In order to heat the developed toner images on copy sheets 51 to a temperature sufficient to melt the toner image, heating means 54 are spaced relative to the belt(s) which have the thermally conductive material on their outer surface. As shown in FIG. 2 heating means 54 is positioned relative to each of belts 49 and 50 prior to the point at which the belts come into contact. In accordance with the present invention any type of radiant heater can be used to heat the outer flexible belt surface such as, for example, an incadescent or quartz lamp radiant type heater. Preferably, a radiant heat source is used in combination with a reflector positioned above the radiant heater that is arranged to direct the radiant heat from the heat source to belts 49 and 50. As belts 49 and 50 are caused to move in the direction shown radiant heaters 54 heats belts 49 and 50 to a point where the temperature of the belt surfaces is at a sufficiently elevated level to cause melting of toner particles 55 on copy sheet 51. Copy sheet 51 with unfused toner particles 55 arrive at the entrance of fusing apparatus 40 between guide plates 56. Immediately thereafter the upper and lower surfaces of copy sheet 51 contact the heated outside surfaces of belts 49 and 50. As the toner melts it is at the same time pressed into the copy sheet by the roller pressure exerted in area 57 by pressure fixing feed rollers 4-1, 4-2, 4-3, 4-4, 4-5 and 4-6.

Occasionally, it is possible for toner particles 55 to be offset to the outer (fusing) surfaces of belts 49 and 50. One possible way to minimize this problem, commonly referred to in the art as "offsetting", would be to provide the outer surfaces of belts 49 and 50 with an outer surface layer or covering of polytetrafluoroethylene, sold under the trademark "Teflon" by the E. I. DuPont de Nemours & Co., to which a release agent such as, for example, silicone oil is applied. Of course any of the procedures known in the art for preventing offsetting can be used. It is preferred in accordance with the present invention when the outer thermally conductive fusing surface of belt(s) 49 and/or 50 is a matal, that any of the known polymeric fluid release materials such as the fluid polymer release materials which oxidize or which contain functional groups can be utilized to prevent offsetting. Examples of these materials include polyethylene, polypropylene, polyorganosiloxanes having functional carboxy groups and polyorganos: loxanes having functional mercapts groups. For further information concerning these types of release agents see, for example, U.S. Pat Nos. 3,918,804, 3,937,637, 4,029,827 and 4,146,659.

Figure 4:
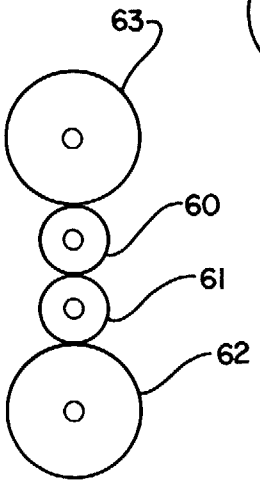
FIG. 4 is a schematic sectional view of an embodiment of a pressure roll assembly.

An alternate embodiment of a fusing apparatus in accordance with the present invention is illustrated in FIG. 5. In accordance with the present invention, one or more pairs of the pressure rollers, such as for example, pairs 41 and 44 or 42 and 45 or 45 and 46 (See FIG. 2) of fusing apparatus 40 may be deleted and then substituted for by a set of pressure rollers as illustrated in FIG. 4. As is well known in the rolling art small rolls are generally more efficient than relatively larger rolls. Hence, in the present system the combination of relatively small diameter working rolls 60 and 61 with larger diameter backing rolls 62 and 63 will efficiently apply roll pressure to copy sheet 51 moving along area 57. In accordance with the present invention in order to keep heat losses to an absolute minimum, each of pressure rolls 60, 61, 62 and 63 are preferably constructed of a metal core having a thin, e.g. 1/16 inch, outer layer of a thermal insulating material. An example of the possible sizes for the pressure rolls illustrated in FIG. 4 would be a one inch outer diameter for rolls 62 and 63 and a 5/16 inch outer diameter for rolls 60 and 61.

Throughout the specification there is reference to the use of thermal conductive material and thermal insulating material. For example, the specification refers to belts 49 and/or 50 being coated with a thermal conductive material and the use of thermal insulating material on the various rolls, (e.g. rolls 41, 42, 43, 44, 45 and 46) employed in fusing apparatus 40 and also on belts 49 and 50. Regarding the thermal conductive materials which can be used, it is certainly with the scope of this invention to use any thermal conductive material which can be placed on a flexible belt configuration in the form of a thin layer, e.g. a layer having a thickness from about 0.003 to about 0.005 inches. For example, metals are preferred as the thermal conductive material. Metals such as stainless steel, copper, nickel plated onto copper, chromium plated onto copper, nickel, nickel alloy, anodized aluminum and aluminum alloys are ideally suited. Various types of thermal insulating materials can be used in accordance with the present invention. For example, the insulating materials used can be a polyester film sold under the trademark "Mylar" by E. I. DuPont de Nemours & Co., an acetal resin sold under the trademark "Delrin" by E. I. DuPont de Nemours & Co., or a nylon resin sold under the trademark "Zytel" by E. I. DuPont de Nemours & Co.

While this invention has been described in conjunction with specific embodiments thereof, it is evident that many alternatives, modifications and variations will be apparent to those skilled in the art. Accordingly, the present invention is intended to embrace all such alternatives, modifications and variations and fall within the spirit of the appended claims.

What is claimed is:

1. A fusing apparatus for applying heat and pressure to a copy sheet to fix a developed toner image thereon, comprising:

a pair of first and second oppositely driven pressure fixing feed rollers, each of the outer surfaces of the rollers comprising a layer of a thermal insulating material;

first and second idler rollers;

A first flexible endless belt disposed about said first idler roller and said first pressure feed roller, and a second flexible endless belt disposed about said second idler roller and said second pressure feed roller, at least one of the belts having an outer surface formed of a thermal conductive material, wherein there is defined an area of contact between the outer surfaces of the first and second belts located between said first and second pressure feed rollers for passing the copy sheet between the two belts under pressure, and heating means spaced relative to the belt whose outer surface comprises the thermal conductive material for heating the outer surface thereof, whereby when an unfused copy sheet is passed through the area of contact between said two belts it is subject to sufficient heat and pressure to fuse a developed toner image thereon.

2. A fusing apparatus according to claim 1 wherein the heating means is a resistance coil heater.

3. A fusing apparatus according to claim 1 wherein each of said belts comprises a backing layer formed of a thermal insulating material and an outer surface formed of said thermal conductive material.

4. A fusing apparatus according to claim 3 wherein said thermal conductive material is a metal selected from the group consisting of stainless steel, copper, nickel plated copper, chromium plated copper, nickel, a nickel alloy, anodized aluminum and an aluminum alloy.

5. A fusing apparatus according to claim 4 wherein said metal surface is coated with a polymeric release fluid.

6. A fusing apparatus for applying heat and pressure to a copy sheet to fix a developed toner image thereon, comprising:

a plurality of pairs of first and second oppositely driven pressure fixing feed rollers, each of the outer surfaces of the rollers comprising a layer of thermal insulating material;

first and second idler rollers;

a first flexible endless belt disposed about said first idler roller and each of said first pressure feed rollers, and a second flexible endless belt disposed about said second idler roller and each of said second pressure feed rollers, at least one of the belts having an outer surface formed of a thermal conductive material, wherein there is defined an area of contact between the outer surfaces of the first and second belts located between said first and second pressure feed rollers for passing the copy sheet between the two belts under pressure, and heating means spaced relative to the belt whose outer surface comprises the thermal conductive material for heating the outer surface thereof, whereby when an unfused copy sheet is passed through the area of contact between said two belts it is subject to sufficient heat and pressure to fuse a developed toner image thereon.

7. A fusing apparatus according to claim 6 further comprising means for driving said pressure feed rollers.

8. A fusing apparatus according to claim 6 wherein said first belt comprises an outer surface of a thermal conductive material over a backing layer of a thermal insulating material and the outer surface of said second belt comprises a thermal insulating material.

9. A fusing apparatus according to claim 6 wherein the heating means is a resistance coil heater.

10. A fusing apparatus according to claim 9 wherein the heating means further comprises a reflector arranged to direct heat from the heater to said belt.

11. A fusing apparatus according to claim 6 wherein each of said belts comprises a backing layer formed of a thermal insulating material and an outer surface formed of said thermal conductive material.

12. A fusing apparatus according to claim 11 wherein said thermal insulating material is Mylar.

13. A fusing apparatus according to claim 11 wherein said thermal conductive material is a metal selected from the group consisting of stainless steel, copper, nickel plated copper, chromium plated coper, nickel, nickel alloys, anodized aluminum and aluminum alloys.

14. A fusing apparatus according to claim 13 wherein the thickness of said metal layer is in the range of about 0.003 inches to about 0.005 inches.

15. A fusing apparatus according to claim 13 wherein said metal surface is coated with a polymeric release fluid.

16. A fusing apparatus according to claim 6 wherein each of said pressure fixing feed rollers comprise a metal core.

17. A fusing apparatus according to claim 16 wherein the thickness of the layer of said thermal insulating material is about 1/16 inch.

18. A fusing apparatus according to claim 6 wherein there is substituted for at least one of said pairs of first and second oppositely driven fixing feed rollers a pressure roller assembly comprising third and forth oppositely driven pressure fixing feed rollers, a fifth roller oppositely driven and cooperating with said third roller, and sixth roller oppositely driven and cooperating with said forth roller, the third and forth rollers having a smaller outside diameter then the fifth and sixth rollers, each of the rollers having an outer surface of a thermal insulating material.

* * * * *